US011600957B2

(12) United States Patent
Copper

(10) Patent No.: US 11,600,957 B2
(45) Date of Patent: Mar. 7, 2023

(54) SELECTIVELY PLATED PLASTIC PART

(71) Applicant: FCI USA LLC, Etters, PA (US)

(72) Inventor: Charles Copper, Hummelstown, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 17/356,156

(22) Filed: Jun. 23, 2021

(65) Prior Publication Data

US 2022/0021162 A1 Jan. 20, 2022

Related U.S. Application Data

(63) Continuation of application No. 16/741,562, filed on Jan. 13, 2020, now Pat. No. 11,056,841, which is a (Continued)

(51) Int. Cl.
*H01R 13/6599* (2011.01)
*H01R 13/502* (2006.01)
(Continued)

(52) U.S. Cl.
CPC ..... *H01R 13/6599* (2013.01); *H01R 13/502* (2013.01); *H01R 13/6581* (2013.01); *H01R 13/6594* (2013.01)

(58) Field of Classification Search
CPC .. H01R 13/6599; H01R 13/42; H01R 13/646; H01R 13/6594; H01R 13/6581; H01R 13/502
See application file for complete search history.

(56) References Cited

U.S. PATENT DOCUMENTS 3,745,515 A 7/1973 Michaels
4,600,480 A 7/1986 Coombes et al.
(Continued)

FOREIGN PATENT DOCUMENTS

CN 1349117 A 5/2002
CN 1436381 A 8/2003
(Continued)

OTHER PUBLICATIONS

International Search Report and Written Opinion for International Application No. PCT/US2016/051079 dated Dec. 14, 2016.
(Continued)

*Primary Examiner* — Jean F Duverne
(74) *Attorney, Agent, or Firm* — Wolf, Greenfield & Sacks, P.C.

(57) ABSTRACT

An electrical connector including a housing and electrical conductor plating. The housing includes a first member and a second member. The first member is made of plastic and forms at least one first contact receiving channel therein. The second member is attached around the first member, and the first and second members form at least one second contact receiving channel therebetween. The electrical conductor plating is on the first member. The electrical conductor plating includes at least one first section along the at least one first contact receiving channel and at least one second section along an exterior side of the first member at the at least one second contact receiving channel. The first and second sections of the electrical conductor plating are electrically separate from one another.

23 Claims, 2 Drawing Sheets

Related U.S. Application Data continuation of application No. 15/759,091, filed as application No. PCT/US2016/051079 on Sep. 9, 2016, now Pat. No. 10,535,959.

(60) Provisional application No. 62/217,184, filed on Sep. 11, 2015.

(51) Int. Cl.
*H01R 13/6581* (2011.01)
*H01R 13/6594* (2011.01)

(56) References Cited

U.S. PATENT DOCUMENTS

| | | | |
|---|---|---|---|
| 5,386,344 | A | 1/1995 | Beaman et al. |
| 5,468,918 | A | 11/1995 | Kanno et al. |
| 6,053,744 | A | 4/2000 | Gray et al. |
| 6,109,959 | A | 8/2000 | Burlinson et al. |
| 6,176,744 | B1 | 1/2001 | Zito et al. |
| 6,276,945 | B1 | 8/2001 | Hayward et al. |
| 6,532,315 | B1 | 3/2003 | Hung et al. |
| 7,316,585 | B2 | 1/2008 | Smith et al. |
| 7,374,459 | B2 | 5/2008 | Lin |
| 7,670,180 | B2 | 3/2010 | Gerard et al. |
| 8,167,652 | B1 | 5/2012 | Ju |
| 8,382,522 | B2 | 2/2013 | Glover et al. |
| 8,465,469 | B2 | 6/2013 | Brightbill |
| 8,540,434 | B2 | 9/2013 | Kruchowski et al. |
| 8,905,785 | B2 | 12/2014 | Johnescu |
| 9,450,344 | B2 | 9/2016 | Cartier, Jr. et al. |
| 10,535,959 | B2 | 1/2020 | Copper |
| 11,018,402 | B2 | 5/2021 | Smith et al. |
| 11,056,841 | B2 | 7/2021 | Copper |
| 2002/0168149 | A1 | 11/2002 | Nakura et al. |
| 2005/0017818 | A1 | 1/2005 | Kinayman et al. |
| 2006/0141861 | A1 | 6/2006 | Darley et al. |
| 2007/0188257 | A1 | 8/2007 | Brunker et al. |
| 2008/0220658 | A1 | 9/2008 | Caveney et al. |
| 2011/0256763 | A1 | 10/2011 | De Geest et al. |
| 2011/0274394 | A1 | 11/2011 | Kruchowski et al. |
| 2012/0244728 | A1 | 9/2012 | Rathburn |
| 2012/0319891 | A1 | 12/2012 | Edvardsson et al. |
| 2013/0050841 | A1 | 2/2013 | Mathai et al. |
| 2014/0174781 | A1 | 6/2014 | Do |
| 2014/0291009 | A1 | 10/2014 | Schreier et al. |
| 2015/0168652 | A1 | 6/2015 | Hamamoto |
| 2018/0287308 | A1 | 10/2018 | Copper |
| 2020/0076039 | A1 | 3/2020 | Smith |
| 2020/0153172 | A1 | 5/2020 | Copper |
| 2021/0384603 | A1 | 12/2021 | Smith et al. |

FOREIGN PATENT DOCUMENTS

| | | | | |
|---|---|---|---|---|
| CN | 1437781 | A | | 8/2003 |
| CN | 1502146 | A | | 6/2004 |
| CN | 1529924 | A | | 9/2004 |
| CN | 101052906 | A | | 10/2007 |
| CN | 101055956 | A | | 10/2007 |
| CN | 201839566 | U | | 5/2011 |
| CN | 102449516 | A | | 5/2012 |
| CN | 102842784 | A | | 12/2012 |
| CN | 102882032 | A | | 1/2013 |
| CN | 103038943 | A | | 4/2013 |
| CN | 202930669 | U | | 5/2013 |
| CN | 103918132 | A | | 7/2014 |
| CN | 203871547 | U | | 10/2014 |
| EP | 0693795 | A1 | | 1/1996 |
| EP | 0692178 | | * | 4/1998 |
| JP | 2012-119263 | A | | 6/2012 |
| WO | WO 00/050942 | A1 | | 8/2000 |
| WO | WO 02/058191 | A2 | | 7/2002 |
| WO | WO 02/101882 | A2 | | 12/2002 |
| WO | WO 2010/126492 | A1 | | 11/2010 |
| WO | WO 2019/162067 | A1 | | 8/2019 |

OTHER PUBLICATIONS

International Preliminary Report on Patentability for International Application No. PCT/US2016/051079 dated Mar. 22, 2018.

International Search Report and Written Opinion for International Application No. PCT/US2017/016004 dated Apr. 25, 2017.

International Preliminary Report on Patentability for International Application No. PCT/US2017/016004 dated Aug. 16, 2018.

Chinese office action for Chinese Application No. 201780009098.9 dated Jan. 2, 2020.

Chinese office action for Chinese Application No. 202010994398.0 dated Jul. 9, 2021.

Chinese office action for Chinese Application No. 202010994398.0 dated Apr. 2, 2022.

Chinese office action for Chinese Application No. 202010994398.0 dated Jun. 6, 2022.

* cited by examiner

SELECTIVELY PLATED PLASTIC PART

RELATED APPLICATIONS

This Application is a Continuation of U.S. application Ser. No. 16/741,562, filed Jan. 13, 2020, entitled "SELECTIVELY PLATED PLASTIC PART", which is a Continuation of U.S. application Ser. No. 15/759,091, filed Mar. 9, 2018, entitled "SELECTIVELY PLATED PLASTIC PART", which is a U.S. national stage filing under 35 U.S.C. 371 of International Patent Application Serial No. PCT/US2016/051079, filed Sep. 9, 2016, entitled "SELECTIVELY PLATED PLASTIC PART", which claims priority to and the benefit under 35 USC 119(e) to U.S. Provisional Application Ser. No. 62/217,184, filed Sep. 11, 2015, entitled "SELECTIVELY PLATED PLASTIC PART", each application of which is herein incorporated by reference in its entirety.

BACKGROUND

Technical Field

The exemplary and non-limiting embodiments relate generally to an electrical connector and, more particularly, to an electrical connector having a Selectively Plated Plastic Part (SPPP).

Brief Description of Prior Developments

Members which are Selectively Plated Plastic Parts (SPPP) are known.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
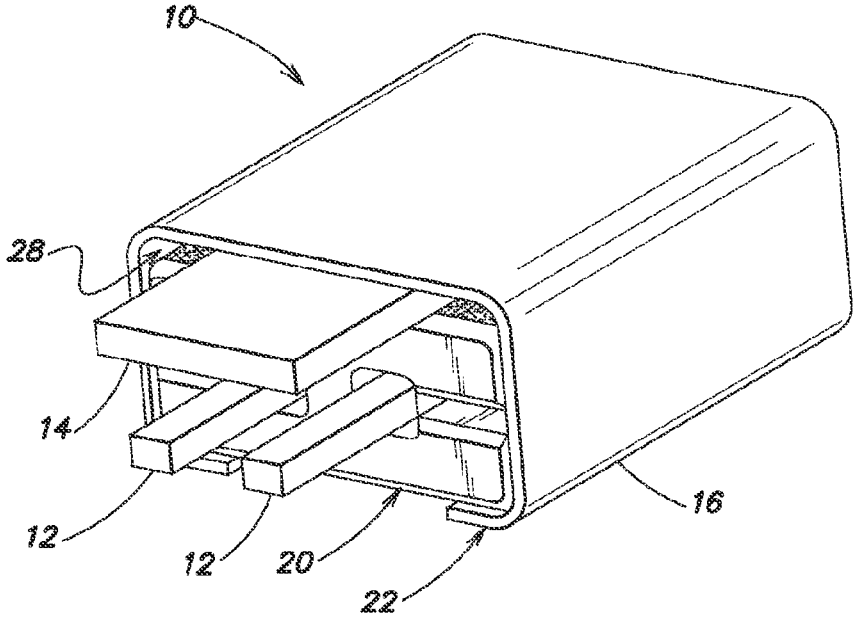
FIG. 1 is a perspective view of an example embodiment.

Referring to FIG. 1, there is shown a perspective view of an electrical connector 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

Figure 2:
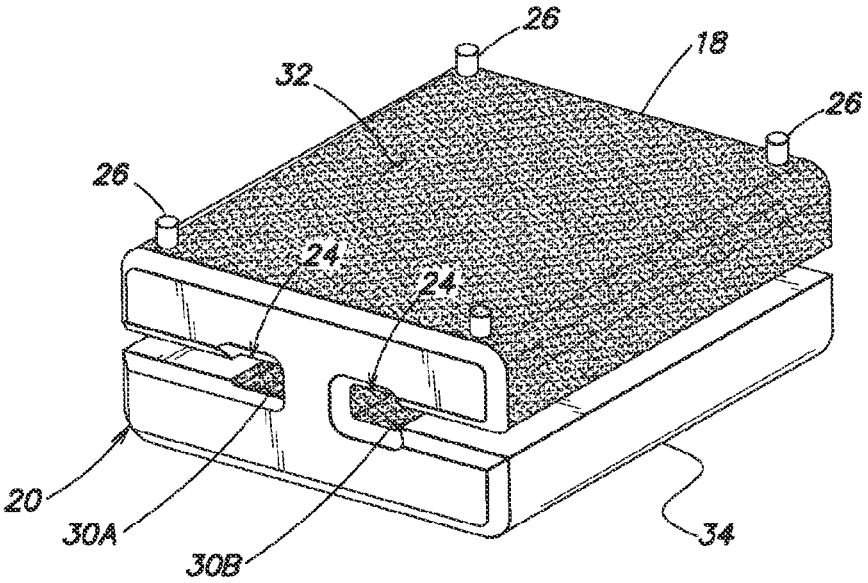
FIG. 2 is a perspective view of one of the components used in the example shown in FIG. 1.

FIG. 1 shows the electrical connector 10 having conductors 12, 14 of a mating electrical connector connected thereto. Referring also to FIG. 2, the connector 10 generally comprises a housing 16 and electrically conductive plating 18. In this example the housing 16 comprises a first housing member 20 and a second housing member 22. The first housing member 20 is made of plastic, such as molded plastic or polymer material.

In this example the first housing member 20 has a general "H" shaped cross section forming two contact receiving channels 24 therein. The "H" shape creates two contact regions partially enclosed by second housing member 22. Such a configuration may be suitable for creating contact regions for signal conductors forming a differential pair. It should be appreciated that a connector may be constructed in which more or fewer signal conductors are grouped, with each group being surrounded by a second housing member.

The "H" shape also proves opposing members at each contact region. The H shape provides compliance to one or both of these members such that force may be applied to a surface of a conducting member (such as a conductor 12) inserted between the opposing member. Such force may be generated by sizing receiving channel 24 formed between the opposing members to be slightly smaller than conductor 12 such that insertion of conductor 12 deflects one or both of the opposing members, and creating contact force. Alternatively or additionally, a member surrounding housing member 20 may generate force on the opposing members, busing them together to generate force on a conductor inserted in the channel. For example, second housing member 22 may act as a clip, constricting the first housing member to urge the opposing members together, and closing receiving channel 24.

A top side of the first housing member 20 also includes standoffs 26. The standoffs 26 may create separation between the first housing member and the second housing member for insertion of a conductor, which as conductor 14, which may serve as a ground or reference conductor. Conductors 12 and 14 may be a portion of a connector 10 to be mated with connector 10. Within the mating connector, impedance of the signal conductors 12 may be influenced by the spacing between conductors 12 and 14. Desirably, this impedance may be maintained through the mating interface illustrated in FIG. 1. Impedance of transmission lines defined by the electrically conductive plating 18 of the first contact receiving channels 24 remains constant even if there are no connector pins 12 received in the contact receiving channels 24.

The second housing member 22 is attached to the first housing member 20 and generally surrounds the first housing member 20. In one example the second housing member 20 forms a clip which is attached to the first housing member and retained thereon by a force caused by resilient deflection of the second housing member when it is clipped to the first housing member. Additional or alternative means may be provided to attached the two housing members to one another. The second housing member may comprise metal or plastic for example. When the second housing member 22 is attached to the first housing member 20, the second housing member 22 rests on top of the standoffs 26. Thus, a second contact receiving channel 28 is formed between the first and second housing members 20, 22 on the exterior side of the first housing member 20 in an area between the standoffs 26.

The electrically conductive plating 18 is applied to the first housing member 20. In this example the electrically conductive plating 18 includes first sections 30A, 30B along each one of the first contact receiving channels 24, and a second section 32 along an exterior side of the first housing member 20 (particularly at the second contact receiving channel 28).

In some embodiments, the plating will be discontinuous. As can be seen in FIG. 2, the plating regions 30A and 30B may be electrically separated from each other. Plating region 18 may be electrically separate from both plating regions 30A and 308. Suitable conductor material is provided to connect the first sections 30A, 30B to contact areas at the bottom side 34 of the first housing member 20. Thus, the bottom side can be attached to a printed circuit board, for example, to electrically connect the first sections 30A, 30B to the printed circuit board. Likewise, the second housing member 22 can be connected to the printed circuit board, such as at a ground contact area, to electrically connect the second housing member 22 and the second section 32 to ground.

Figure 3:
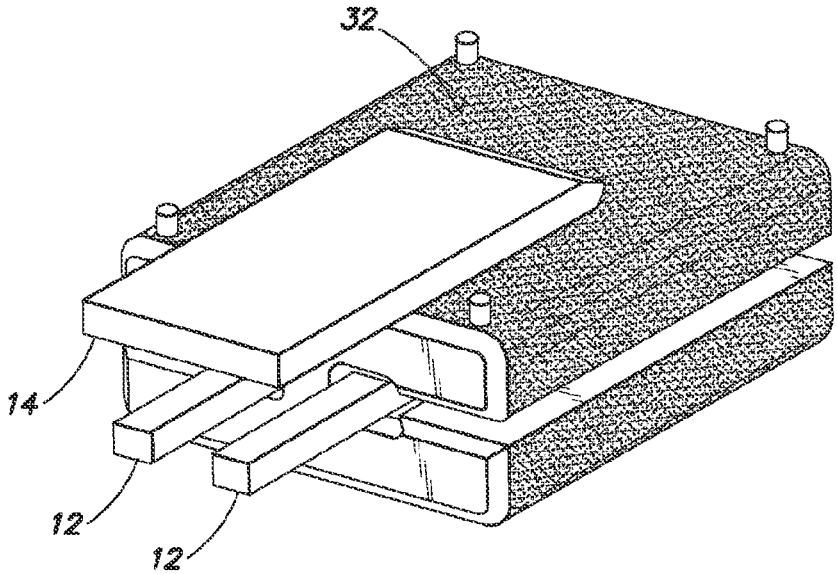
FIG. 3 is a perspective view of the component shown in FIG. 2 showing the contacts of a mating connector attached thereto.

Referring also to FIG. 3, two connector pins 12 of the mating electrical connector can be inserted into the two contact receiving channels 24 to electrically connect the pins 12 to the two first sections 30A, 30B. This electrically contacts the pins 12 to the printed circuit board. The connector blade 14 of the mating connector can be received into the second contact receiving channel 28 and make electrical contact to the printed circuit board via the second section 32 and/or the second housing member 22.

With these types of features, a selectively plated plastic member at a separable interface may be used for a high speed connector. The high speed connector may be, for example, a backplane connector, or a mezzanine connector, or an Input Output (IO) application. Such a connector may have multiple signal conductors or pairs of signal conductors, such that the elements shown in FIGS. 1-3 would be understood to relate to a portion of a connector. A full connector may have multiple such elements, held together in an insulative or conducting housing, or in any other suitable way, to form a connector.

Figure 4:
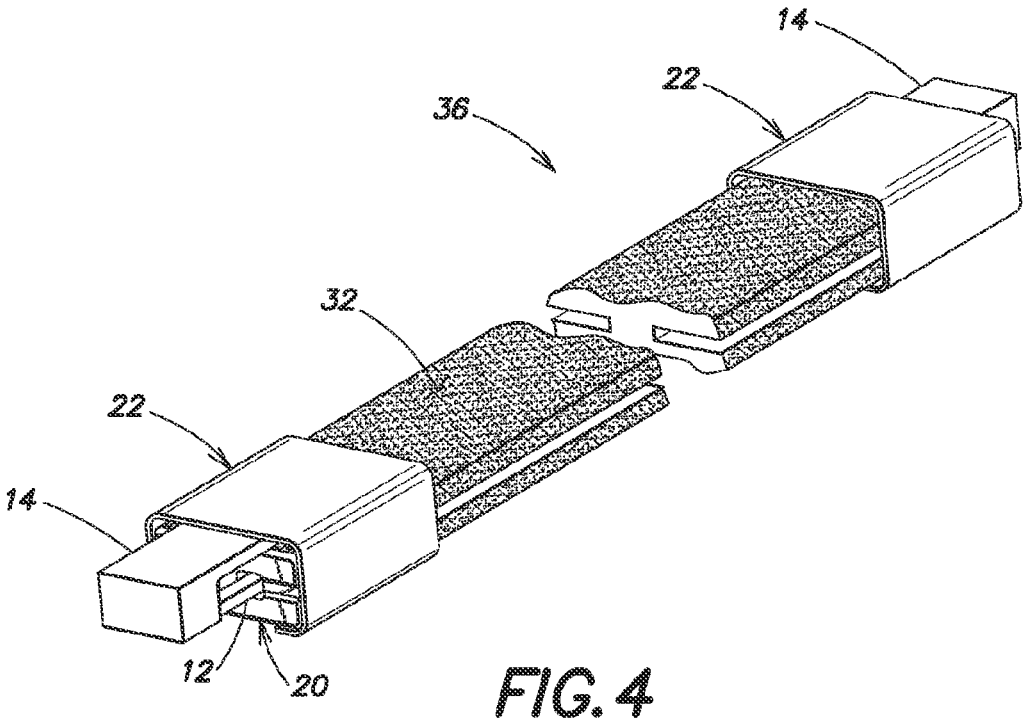
FIG. 4 is a perspective view of another example embodiment.

Referring also to FIG. 4, an alternative example may be provided in a transmission line 36 using an elongated electrically conductive plated plastic member 20' and end clips 22. One benefit is improved impedance consistency. As shown in the drawings, the metalized plastic can form a cable (the outer insulative jacket is not shown) or other transmission path. Mating connector pins 12 are inserted into the ends of the metalized plastic body. The wider pin 14 is a ground pin, and the two smaller pins 12 are the signal pins. The ground pin is electrically isolated from the signal pins.

The outer second section 32 of the plating may be connected to ground, and the two smaller internal plated areas may be for signal paths. The outer second section 32 of the plating extends the length of the H-shaped, metalized plastic housing member.

In one example of a manufacturing method, the entire part 20 or 20' can be plated by vapor deposition and then machined to remove unwanted plating. The H-shaped housing member can also be molded as two sections and attached along a horizontal split (black line) through the center of the I-beam shape. Other suitable methods are also acceptable.

In some embodiments, the first and second housing members may each be unitary structures. Alternatively or additionally, either or both may be formed from multiple components. For example, in a two-ended structure as shown FIG. 4, each end of the connector may have a separate component acting as an inner housing.

In the example of FIG. 4, each end is the same. However, it is not a requirement that ends be the same. In some embodiments, for example, one end may be configured to receive conductors from a mating connector. A second end may be configured to attach to a printed circuit board or other substrate. That end, for example, may be configured to receive pins or other conductive elements that can be inserted into a via in a printed circuit board or otherwise attached to a substrate.

As another example, the portions between the two ends may be made differently than the portions at the ends. An end may have a housing made of plated plastic as described above. That housing may have two faces. One face may have openings to receive conductors from a mating connector, such as with the configuration shown in FIG. 3. With channels running through the housing, there may be openings on a second face. Other types of conductors may be inserted into openings in the second face. As a specific example, conductors that are or attached to conductors or a cable may be inserted into the openings in the second face. In this way a connector having the characteristics of connector 10 housing may terminate a cable. Additionally, it should be appreciated that other types of elements may be inserted into openings in the second face to achieve different types of structures. For example, pins or other contacts for mounting to a printed circuit board may be inserted in the second face. Regardless off rom and purpose, the elements in the second face may make electrical contact to the plated plastic, forming electrical connections to the conductors, such as 12 and 14 inserted into the first face.

In one example the clips 22 are compression clips that simultaneously provide normal force on all of the mating pins 12, 14. The standoffs 26 are provided so that the clips 22 to not flop around when the header pins 12, 14 are not yet inserted into the metalized plastic body.

Using a Selectively Plated Plastic Part (SPPP) 20, 30, 32 as the separable interface enables all of the critical dimensions (for impedance) to be controlled by one piece. This provides consistency. To mate to this part, pins 12 are inserting into internal (plated) cavities 24, 30 and a blade 14 is fitted to the side of the part to connect to the plating 32 which may also act as a ground shield. The first sections 30A, 30B may form a differential pair of conductors, and the plating 32 may act as the ground shield for that differential pair. The clip 22 may compress the whole thing together to provide the contact force.

In an IO application such as shown in FIG. 4, the SPPP is extending to be a cable, and the compressive clips 22 are applied at both ends as well as mating interfaces. In these examples differential pairs were used to demonstrate the concept, but it could be applied to different configurations.

An example embodiment may be provided in an electrical connector comprising a housing comprising a first member and a second member, where the first member is made of plastic and forms at least one first contact receiving channel therein, where the second member is attached around the first member, and where the first and second members form at least one second contact receiving channel therebetween; and electrical conductor plating on the first member, where the electrical conductor plating comprises at least one first section along the at least one first contact receiving channel and at least one second section along an exterior side of the first member at the at least one second contact receiving channel, and where the first and second sections of the electrical conductor plating are electrically separate from one another.

An example embodiment may be provided in an electrical connector comprising: a housing comprising a first member made of an electrically insulative material that forms at least one first contact receiving channel therein; and electrical conductor plating on the first member, where the electrical conductor plating comprises at least one first section along the at least one first contact receiving channel and at least one second section along an exterior side of the first member where the first and second sections of the electrical conductor plating are electrically separate from one another.

The first section may be configured to transmit signals. The second section may be configured to be electrically connected to one of power or ground. The at least one first contact receiving channel may define two contact receiving channels that are electrically isolated from one anther. The two contact receiving channels may be configured to carry differential signals and have a differential impedance of 100±10 Ohms or 85±10 Ohms. The differential impedance might not change even if there are no connector pins received in one or both of the two contact receiving channels. The electrical connector may further comprise a second member, wherein the second member is attached around the first member, and where the first and second members form least one second contact receiving channel therebetween. The two contact receiving channels may be C-shaped and are oriented in a mirror image with respect to one another. The C-shaped two contact receiving channels may be oriented back-to-back with openings extending away from each other. The housing may be mechanically flexible. The housing may be part of an electrical cable assembly.

An example embodiment may be provided in an electrical connector comprising: a housing comprising a first member made of plastic that forms at least one first contact receiving channel therein, the at least one first contact receiving channel defined by only three closed walls to form a partially open C-shaped cavity; and electrical conductor plating on the first member, where the electrical conductor plating comprises at least one first section along the at least one first contact receiving channel.

The first section may be configured to transmit signals. The electrical conductor plating may further comprise at least one second section along an exterior side of the first member at an at least one second contact receiving channel, and where the first and second sections of the electrical conductor plating are electrically separate from one and the second section is configured to be electrically connected to one of power or ground. The at least one first contact receiving channel may define two contact receiving channels that are electrically isolated from one another. The two contact receiving channels may be configured to carry differential signals and have a differential impedance of 100±10 Ohms or 85±10 Ohms. In one example it may be configured such that the differential impedance does not change even if there are no connector pins received in one or both of the two contact receiving channels. The electrical connector may further comprise a second member, wherein the second member is attached around the first member, and where the first and second members form at least one second contact receiving channel therebetween. The two contact receiving channels may be C-shaped and are oriented in a mirror image with respect to one another. The C-shaped two contact receiving channels may be oriented back-to-back with openings extending away from each other. The housing may be at least partially mechanically flexible. The housing may be part of an electrical cable assembly.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A connector module for an electrical connector, the connector module comprising:

an insulative member;

a first section of electrically conductive plating elongated in a first direction on an interior surface of a cavity of the insulative member, the cavity being open on a side of the cavity that faces a second direction perpendicular to the first direction; and a second section of electrically conductive plating elongated in the first direction on an exterior surface of the insulative member that at least partially surrounds the cavity, the first and second sections of electrically conductive plating being electrically separate from one another.

2. The connector module of claim 1, wherein the interior surface of the cavity comprises first and second walls and a third wall connecting the first and second walls, and wherein the first section of electrically conductive plating is disposed at least on the third wall of the cavity.

3. The connector module of claim 2, further comprising a third section of electrically conductive plating elongated in the first direction on an interior surface of a cavity of the insulative member that is electrically separate from the first and second sections.

4. The connector module of claim 3, further comprising an insulative housing that includes the insulative member, the insulative housing comprising:

a first cavity having an interior surface with the first section of electrically conductive plating thereon, the first cavity being open on a first side of the first cavity that faces the second direction; and a second cavity having an interior surface with the third section of electrically conductive plating thereon, the second cavity being open on a side of the second cavity that faces a third direction opposite the second direction.

5. The connector module of claim 4, wherein:

the interior surface of the first cavity comprises the first, second, and third walls; and the interior surface of the second cavity comprises fourth and fifth walls and a sixth wall connecting the fourth and fifth walls; and the third section of electrically conductive plating is disposed at least on the sixth wall.

6. The connector module of claim 5, wherein the first and third sections of electrically conductive plating are configured to carry respective components of a differential signal.

7. An electrical connector, comprising:

a support; and a plurality of connector modules held by the support, each connector module comprising:

an insulative member;

a first section of electrically conductive plating elongated parallel to a first axis on a first surface of the insulative member; and a second section of electrically conductive plating elongated parallel to the first axis on a second surface of the insulative member that is electrically separate from the first section of electrically conductive plating and positioned, at least in part, on each side of the insulative member about the first axis.

8. The electrical connector of claim 7, wherein the first section of electrically conductive plating is configured to carry an electrical signal and the second section of electrically conductive plating is configured to carry ground current parallel to the first section.

9. The electrical connector of claim 8, wherein the second section of electrically conductive plating comprises first and second portions separated from one another other along a perimeter surrounding the first section of electrically conductive plating by at least one gap.

10. The electrical connector of claim 9, wherein the at least one gap is electrically insulative.

11. The electrical connector of claim 10, wherein the at least one gap comprises a pair of gaps positioned opposite one another along the perimeter surrounding the first section of electrically conductive plating.

12. The electrical connector of claim 7, further comprising a third section of electrically conductive plating on the insulative member of each connector module that is electrically separate from the first and second sections of electrically conductive plating.

13. The electrical connector of claim 12, wherein the second section of electrically conductive plating at least partially surrounds the second section on each side about the first axis.

14. The electrical connector of claim 12, wherein the first and third sections are configured to carry respective components of a differential signal.

15. A method of engaging an electrical connector to an electronic component, wherein the electrical connector comprises an insulative member and an elongated first section of electrical conductor and an elongated second section of electrical conductor plated on the insulative member, the elongated first section and the elongated second section being elongated in a first direction, and the first and second sections being configured to carry respective components of a differential signal, the method comprising:

urging the first member towards the electronic component such that the elongated first section and the elongated second section electrically couple to a respective differential pair of conductive elements of the electronic component.

16. The method of claim 15, wherein the electronic component comprises a second electrical connector, and urging the first member towards the electronic component comprises electrically coupling the elongated first section and the elongated second section to a respective differential pair of mating electrical contacts of the second electrical connector.

17. The method of claim 15, wherein the electronic component comprises a printed circuit board, and urging the first member towards the electronic component comprises electrically coupling the elongated first section and the elongated second section to a respective differential pair of electrically conductive elements of the printed circuit board.

18. The method of claim 15, wherein the electrical connector further comprises an elongated third section of electrical conductor plated on the insulative member to provide a ground path for the first and second sections, and wherein urging the first member towards the electronic component comprises electrically coupling the third section to a ground conductive element of the electronic component.

19. A method of forming an electrical connector comprising a first section of electrically conductive plating and a second section of electrically conductive plating that are electrically separate from one another, the method comprising:

forming a plated plastic housing member at least in part by depositing, using vapor deposition, electrically conductive plating on one or more surfaces of a plastic housing member, the electrically conductive plating comprising the first section of electrically conductive plating and the second section of electrically conductive plating; and assembling the plated plastic housing member, together with a plurality of like plated plastic housing members, into a support with the first and second sections of electrically conductive plating exposed for mating with electrically conductive portions of a mating component or mounting to electrically conductive portions of a printed circuit board.

20. The method of claim 19, wherein forming the plated plastic housing member further comprises positioning the first and second sections to carry respective components of a differential signal.

21. The method of claim 20, further comprising positioning a metal component at least partially around the first and second sections of electrically conductive plating.

22. The method of claim 19, wherein forming the plated plastic housing member further comprises removing at least a portion of the vapor deposited electrically conductive plating to electrically separate the first section of electrically conductive plating from the second section of electrically conductive plating.

23. A method of forming an electrical connector, the method comprising:

forming a plated plastic housing member at least in part by:

depositing, using vapor deposition, on more or more surfaces of a plastic housing member, a first section of electrically conductive plating and a second section of electrically conductive plating; and depositing, using vapor deposition, a third section of electrically conductive plating on a surface that at least partially surrounds the one or more surfaces having the first and second sections thereon, wherein the plated plastic housing member is formed such that the first and second sections of electrically conductive plating are electrically separate from one another, and the third section of electrically conductive plating is electrically separate from the first and second sections of electrically conductive plating.

* * * * *